US005123211A

United States Patent [19]

Schlicht et al.

[11] Patent Number: 5,123,211

[45] Date of Patent: Jun. 23, 1992

[54] GARAGE DOOR LITE AND METHOD OF ASSEMBLING SAME

[75] Inventors: Larry J. Schlicht, Oxford; David K. Wegner, Milford, both of Mich.

[73] Assignee: The Stanley Works, New Britain, Conn.

[21] Appl. No.: 645,206

[22] Filed: Jan. 24, 1991

[51] Int. Cl.[5] ..... E06B 1/34

[52] U.S. Cl. ..... 52/202; 52/311; 52/314; 52/741; 52/456; 29/449

[58] Field of Search ..... 52/314, 456, 455, 311, 52/397, 202, 203, 741, 211; 40/575; 29/449

[56] References Cited

U.S. PATENT DOCUMENTS

| | | | |
|---|---|---|---|
| D. 303,814 | 10/1989 | Beck . | |
| 656,130 | 8/1900 | Whipple | 52/476 |
| 1,199,893 | 10/1916 | Herrmann | 52/311 |
| 2,780,846 | 2/1957 | Lyon . | |
| 2,935,769 | 5/1960 | Lutes . | |
| 2,975,491 | 3/1961 | Paul et al. . | |
| 3,169,281 | 2/1965 | Clements | 52/476 |
| 3,504,468 | 4/1970 | Martin | 52/311 |
| 3,596,420 | 8/1971 | Ducker . | |
| 3,760,543 | 9/1973 | McAllister | 52/455 |
| 3,763,606 | 10/1973 | Rindebong . | |
| 3,913,293 | 10/1975 | Bischoff | 52/456 |
| 4,041,663 | 8/1977 | Mazzoni . | |
| 4,044,813 | 8/1977 | Emmons . | |
| 4,083,153 | 4/1978 | Sumpter . | |
| 4,335,170 | 6/1982 | Butler . | |
| 4,376,359 | 3/1983 | Redman | 52/397 |
| 4,562,675 | 1/1986 | Baigas, Jr. et al. . | |
| 4,586,306 | 5/1986 | Webb . | |
| 4,671,031 | 6/1987 | Intengan . | |
| 4,947,597 | 8/1990 | Simpson | 52/397 |

*Primary Examiner*—John E. Murtagh

[57] ABSTRACT

A door assembly includes a door having an aperture therein and a window frame mounted in the aperture. A glazing member is mounted in the frame which has recesses formed about the glazing member. A trim panel dimensioned to overlie the glazing member has opposed ends seated in opposed recesses of the frame, and a filler strip has an engagement portion seated in another one of the recesses and a retainer portion extending outwardly of the recess.

22 Claims, 4 Drawing Sheets

GARAGE DOOR LITE AND METHOD OF ASSEMBLING SAME

BACKGROUND OF THE INVENTION

The present invention relates to doors with glazing panels or lites therein, and more particularly, to door lites with decorative configurations.

Lites are conventionally provided in exterior doors to admit lite and to allow the persons within a building to observe the exterior. Such lites conventionally employ glass glazing panels, but more recently glazing panels have also been fabricated from polycarbonate and other resins providing the desired degree of transparency or translucency.

In doors for homes and some business buildings, it is frequently desirable to provide decorative configurations for the lites, and this has generally required relatively complex configurations for the frames holding the transparent or translucent panels. This, in turn, has involved the necessity for rather complex configurations for the recesses within the door to receive the frames for the lites. Moreover, if the transparent or translucent panel is broken or otherwise needs to be replaced, any special configuration introduces substantial problems from the standpoint of such replacement.

As a result, garage doors which also frequently employ lites generally utilize a conventional rectangular configuration for the lites so as to minimize costs and the problems in replacement. As a result, the lites on garage doors may not necessarily conform to the decoratively configured lites which may be employed on other doors on the same face of the building.

It is an object of the present invention to provide a novel door lite construction with an ornamental configuration.

It is also an object to provide such a door lite construction in which a conventional rectangular frame and transparent glazing panel may be employed for the basic structure.

Another object is to provide such a door lite construction in which the ornamental configuration of the lite may be readily altered.

A further object is to provide a novel method for assembling decoratively configured door lites.

SUMMARY OF THE INVENTION

It has now been found that the foregoing and related objects may be readily attained in a door assembly including a door having an aperture therein for mounting a lite and a lite frame mounted in the aperture. A glazing member is mounted in the lite frame which has recesses formed adjacent the glazing member extending along opposed sides thereof and along at least one other side. A trim panel dimensioned to overlie the glazing member has opposed ends seated in the opposed recesses. A filler strip has an engagement portion seated in another one of the recesses and body portion substantially closing the entry to the recess.

In one embodiment, the filler strip is a retainer member with a retainer portion outwardly of the body portion and providing a lip overlying a marginal portion of the trim panel. In another embodiment, the filler strip is a sealing member.

Desirably, the recesses in the frame extend about the entire periphery of the glazing member, and the frame provides channels in the recesses spaced outwardly from the glazing member and a lip extending towards the glazing member. The filler strip has a deflectable lip on the engagement portion which is deflectable during insertion into the recess, and it seats in the channel inwardly of the lip on the frame.

The trim panel member is resiliently deflectable, and it is fabricated from synthetic resin sheet material.

BRIEF DESCRIPTION OF THE ATTACHED DRAWINGS

DETAILED DESCRIPTION OF THE ILLUSTRATED EMBODIMENTS

Figure 1:
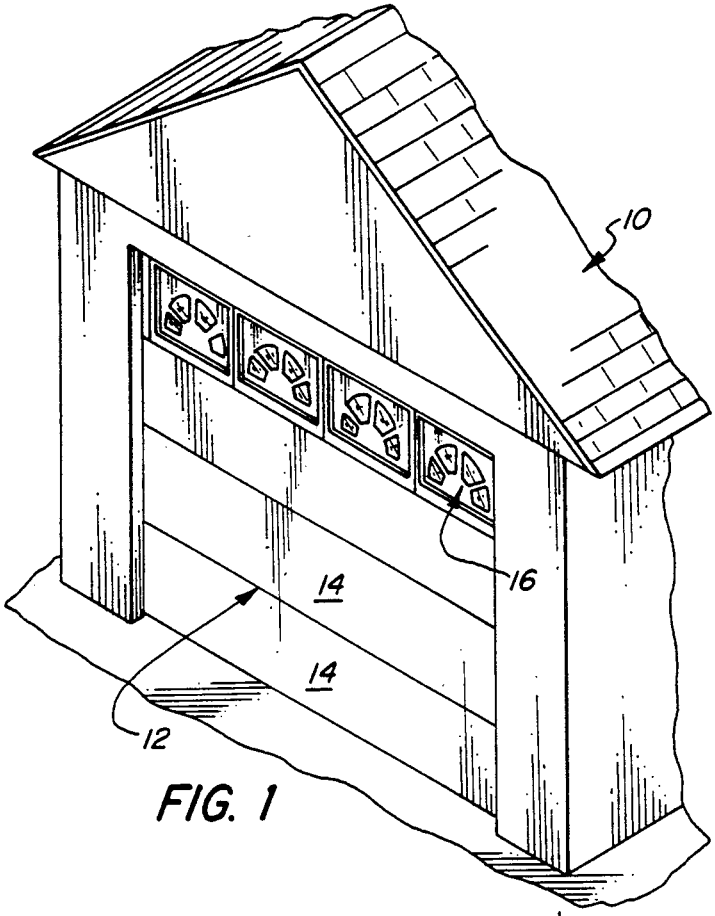
FIG. 1 is a fragmentary perspective view of a garage having a door embodying the novel decoratively configured lite construction of the present invention.

Turning first to FIG. 1, therein fragmentarily illustrated is a garage generally designated by the numeral 10 having a door opening in which is mounted a roll-up door generally designated by the numeral 12 comprised of a series of horizontal panels 14. In the upper most of the panels 14 are a series of lite assemblies embodying the present invention and generally designated by the numeral 16.

Figure 5:
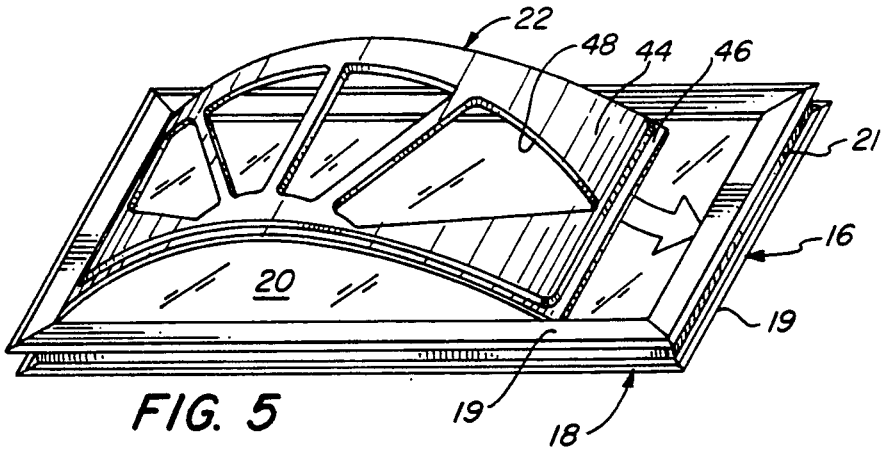
FIG. 5 is a fragmentary perspective view of the lite assembly of FIGS. 1 and 2 with the decorative trim panel shown as bowed during the process of insertion into the frame.
Figure 6:
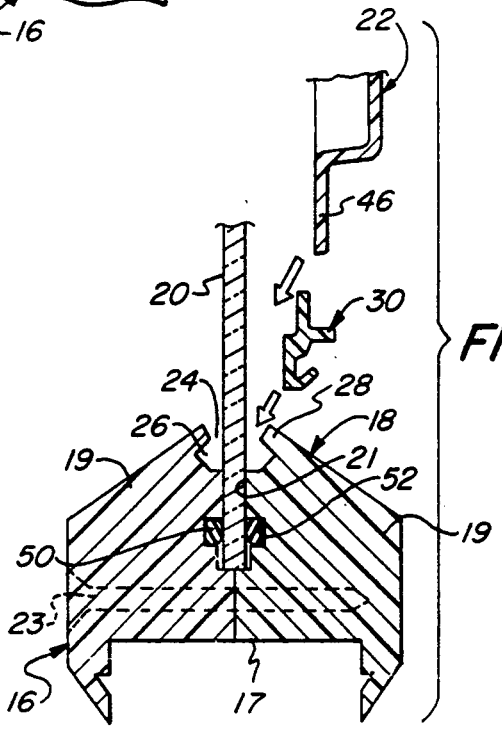
FIG. 6 is a fragmentary cross sectional view of the lower portion of the lite assembly with the retainer strip and decorative insert disassembled therefrom.

As seen in FIG. 2 and FIGS. 5–8, the lite assemblies 16 comprise a rectangular frame generally designated by the numeral 18 formed by a series of extruded framing elements 19, and which, when assembled, provide a recess 17 extending about the outer periphery thereof to snugly seat therewithin cooperating portions of the door panels 14. The framing elements 19 also are cooperatively configured to provide a narrow channel 21 therebetween and extending about the inner periphery thereof in which is seated the glazing panel 20 with sealing recesses 52 in which are disposed caulking 50 to provide an effective seal thereabout. Adjacent the innermost margins of the framing elements 19 is a peripheral recess 24 through which the glazing panel 20 extends, and this opens into a channel 26 which is disposed inwardly of the lip 28. As seen in FIG. 6 in phantom dotted line, fastening elements 23 are spaced about the frame 18 to secure the two half sections of the frame 18 in assembly, and thereby tightly secure the glazing panel 20 therebetween.

In accordance with the present invention, a decorative trim panel generally designated by the numeral 22 is inserted into the outer surface of the frame 18 over the glazing panel 20, and its marginal portions 46 along the sides and top fit into the recesses 24 on the inner periphery of the frame. Along the bottom of the trim panel 22 and seated in the bottom recess 24, is a retainer strip generally designated by the numeral 30, and it has a retainer lip 34 which extends over the marginal portion 46 of the trim panel 22 so as to retain it in position. The retainer 30 has an engagement portion which extends inwardly of the recess 24 with an engagement lip 32 extending into the channel 26 behind the lip 28 upon the frame element 19. The body portion 33 has an outwardly projecting tab 35 which spaced closely to the lip 28 of the frame element 19 and which extends thereover to deflect water from entering the recess 24.

Figure 4:
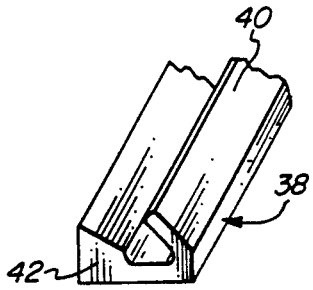
FIG. 4 is a fragmentary perspective view of a sealing strip employed in lite assemblies of the present invention.
Figure 3:
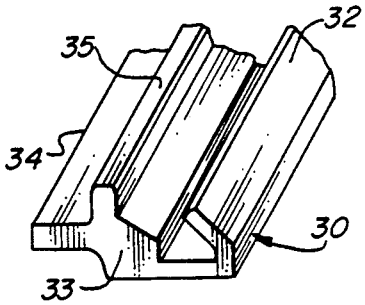
FIG. 3 is a fragmentary perspective view of the retainer strip utilized in the lite assembly of FIGS. 1 and 2.
Figure 8:
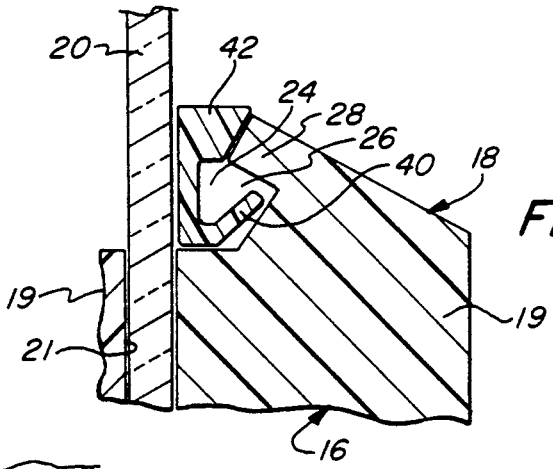
FIG. 8 is a fragmentary sectional view of a lite assembly having a sealing strip seated in the peripheral channel about the lite glazing panel.

In FIGS. 4 and 8, there is seen a sealing member generally designated by the numeral 38 which has a body portion 42 dimensioned and configured to fit snugly within the recess 24 against the lip 28, and an engagement lip 40 extending within the channel 26 to retain the sealing member 38 in assembly.

Figure 2:
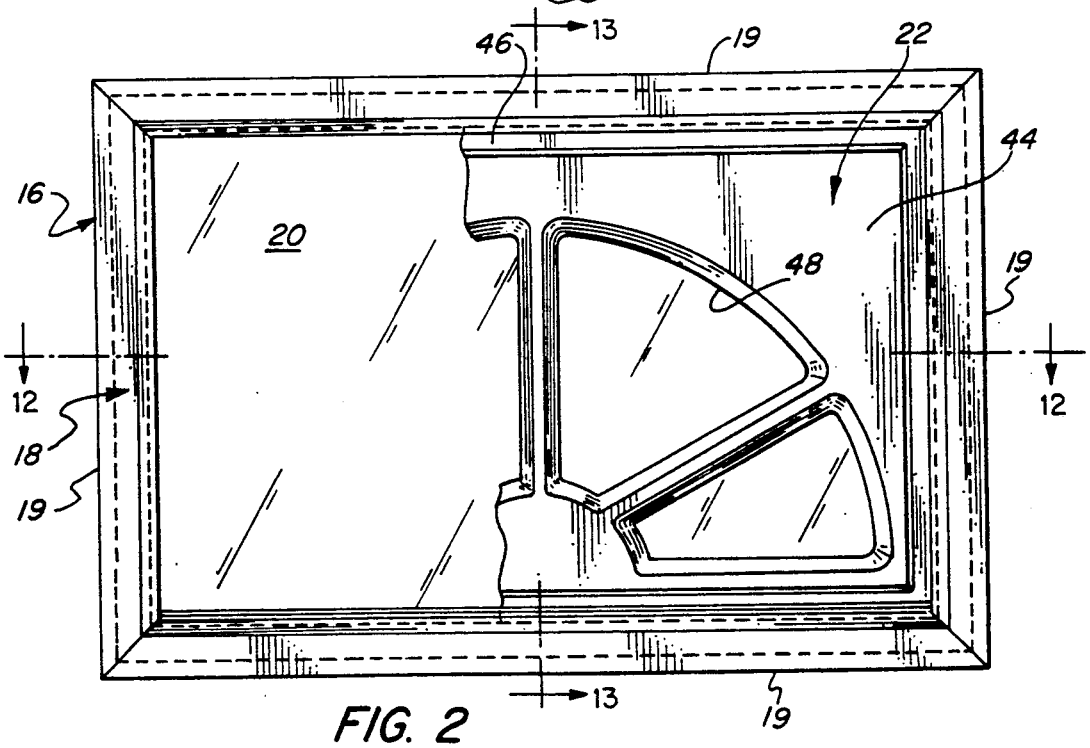
FIG. 2 is an enlarged front elevational view of one of the lites of FIG. 1 with a portion of the decorative trim panel and retainer strip broken away to reveal the underlying construction.

As seen in FIGS. 2, 5 and 6, the trim panel 22 is molded with a body portion 44 and a depending L-shaped marginal portion 46. Apertures 48 of varying orientation are provided within the body portion 44 to provide the desired overall appearance. The resin from which the trim panel 22 is fabricated desirably has the same coloration as the frame 18 so as to present what appears to be a unitary appearance with only the transparent portions of the glazing panel 20 being visible through the apertures 48 and thereby being differentiatable at a distance.

Figure 7:
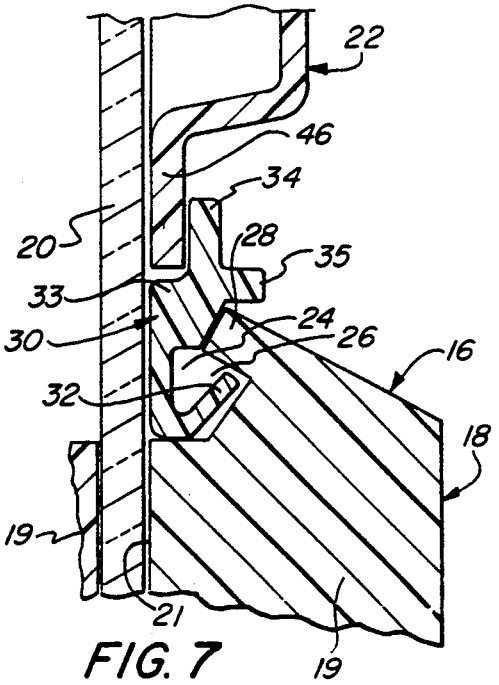
FIG. 7 is a similar view to an enlarged scale with the elements in assembly.

In assembling the trim panel 22 of the embodiment of FIGS. 1-8, the elongated panel 22 is flexed along its length as seen in FIG. 5, with one side edge inserted into the inner peripheral channel 26 under the lip 28. The other side edge of the panel 22 is then slid along the surface of the glazing panel 20 and under the lip 28 to seat in the channel 26 along the opposing side of the frame 18. The trim panel 22 is then pushed upwardly under the lip 28 and into the channel 26 along the upper side of the frame 18. The flexible retainer strip 30 is then inserted into the channel 24 along the bottom edge of the glazing panel 20 as seen in FIGS. 6 and 7. As a result, the trim panel 22 is kept in a position seated within the upper channel 24, so that all four side margins of the trim panel are fully retained either within the frame channels 26 or under the retainer lip 34 of the retainer 30.

Figure 9:
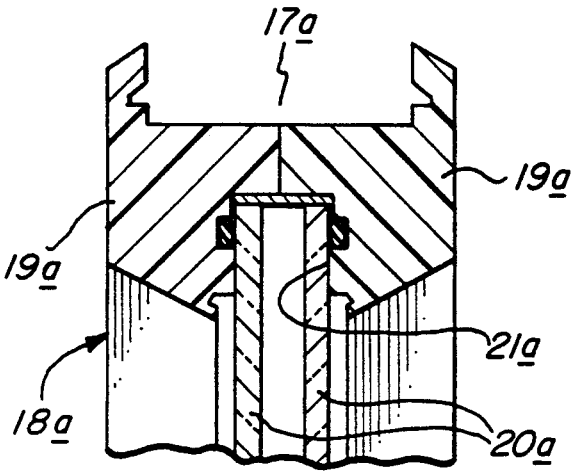
FIG. 9 is a fragmentary sectional view of another embodiment of the glazing panel mounted in a modified frame of the lite assembly.

Turning next to FIG. 9, the elements **19*a* of the frame 18*a* have been modified to provide a larger channel 21*a* for seating a double walled insulated glazing panel 20*a*. However, the framing elements 19 are similarly configured from the standpoint of providing the peripheral channels 17 and 26 and the retainer lip 28, so that the same retainer strip 30 and sealing strips 38** may be employed in connection therewith.

Figure 10:
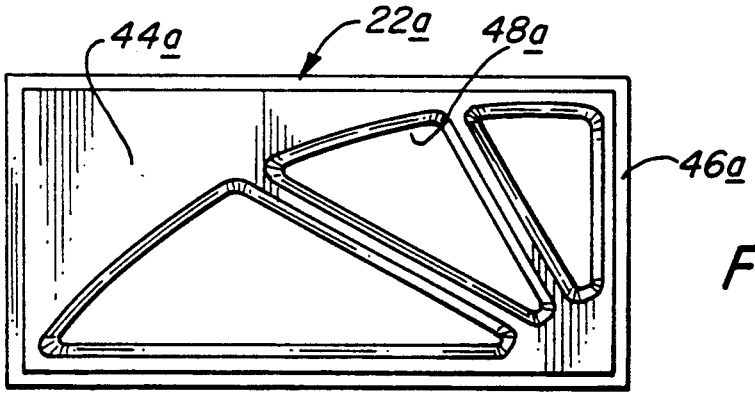
FIG. 10 is a front elevational view of another embodiment of decoratively configured trim panel.

In FIG. 10, there is illustrated an alternate design for a trim panel **22*a* which has a series of differently sized and oriented apertures 48*a* in the body portion 44*a***. This may be assembled in the same fashion as the prior embodiment.

Figure 11:
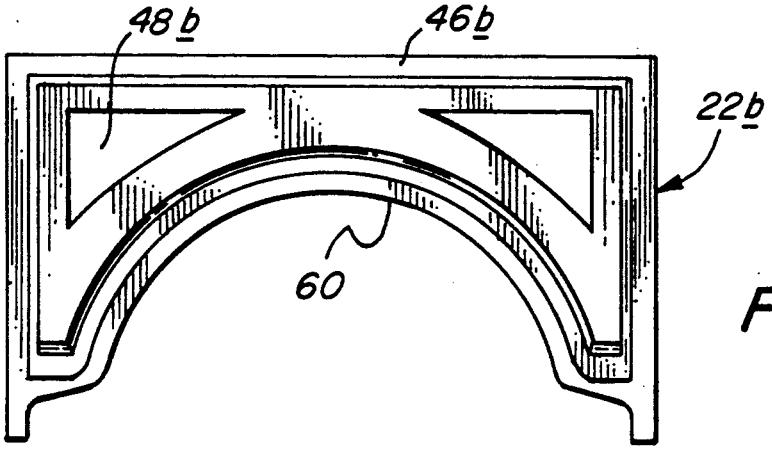
FIG. 11 is a front elevational view of still another embodiment of decoratively configured trim panel.
Figure 12:
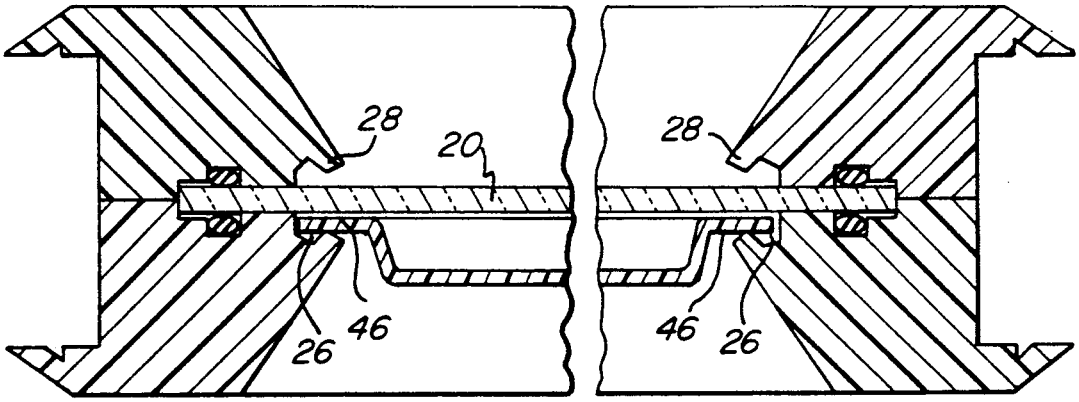
FIG. 12 is a sectional view along the line 12—12 of FIG. 2.
Figure 13:
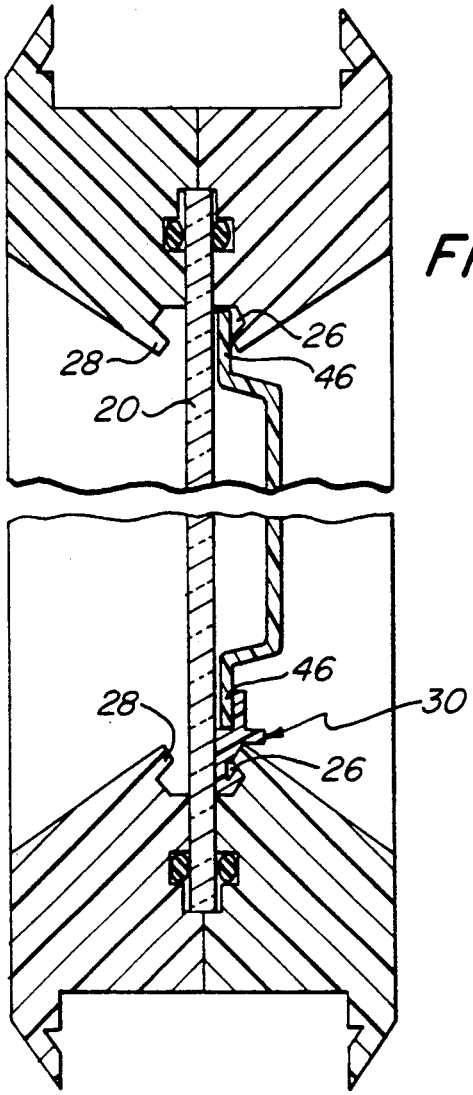
FIG. 13 is a sectional view along the line 13—13 of FIG. 2.

Lastly, turning to FIG. 11, therein is a different style trim panel **22*b* which is not of general rectangular peripheral configuration, but which has an arched recess 60 extending inwardly from the bottom thereof, as well as two smaller spaced generally triangular embossments 48*b*. In assembling this embodiment within the lite assemblies 16 of the present invention, a sealing strip 38 is disposed in the channel 26 along the bottom of the glazing panel 20**.

Although the preferred structures of the present invention utilize frames which are fabricated from foamed synthetic resin, conveniently by extrusion or molding, they may also be fabricated from wood, metal and solid or tubular synthetic resin. Similarly, the trim panels are desirably molded or thermoformed from relatively flexible synthetic resin materials to permit the bowing required to effect insertion into the side recesses of the frame. However, they may also be fabricated from metal, foamed synthetic resin, thermosetting synthetic resin and translucent synthetic resin materials if so desired, and they need not necessarily be fabricated from flexible materials since the retainer strips can be utilized around the entire perimeter to retain the trim panels within the lite assembly.

From the standpoint of ease of assembly and providing the optimum life for the components, the retaining and sealing strips are fabricated from synthetic resin, conveniently as single or dual durometer extrusions since the section is essentially constant. Desirably, a relatively low durometer or flexible resin is employed for such fabrication to facilitate the snapping of the engagement portions into the recesses and channels in the periphery of the framing element. Suitable resins include polyurethanes, polyvinyl chloride, thermoplastic elastomers, acrylontrile/butadiene/styrene terpolymers (ABS) and other resins exhibiting reasonably long life and good weathering characteristics.

It will be readily appreciated that a broken glazing panel may be replaced by removing one-half of the frame, and this will generally be the interior half since the fasteners are desirably oriented so that the heads are disposed on the interior of the door. When it is desired to do so, the trim panel may be readily replaced by reversing the installation procedure to remove the trim panel, and substituting new panels in the same fashion as originally employed.

Although the decorative trim panels may differ in color from the framing elements, it is generally desirable to have the colors closely approximate each other so that the structure appears to be unitary and only the exposed glazing panel differs in color and texture.

Thus, it can be seen from the foregoing detailed description and attached drawings that the door installations employing the lite assemblies of the present invention may be readily fabricated and repaired, and the decorative trim panels can be readily exchanged to alter the appearance of the door or to replace the trim panels which may have become worn or discolored as a result of in use. The components are readily and economically fabricated and assembled to provide a long-lived door.

Having thus described the invention, what is claimed is:

1. A door assembly including:

(a) a door having an aperture therein for mounting a window;

(b) a window frame mounted in said aperture and having inner surfaces defining an opening, said inner surface having aligned channels therein extending about said opening;

(c) a glazing member mounted in said channels of said frame, said inner surfaces of said frame also having recesses formed therein adjacent said glazing member and extending along the exposed length of opposite sides and along the length of at least one other side thereof, said recesses being of lesser depth than said channels;

(d) a resiliently deflectable trim panel having opposite sides and ends, said panel overlying said glazing member with said opposite sides seated in said opposed recesses, said trim panel being releasably retained in said recesses along said opposite sides and insertable into and removable from said recesses along said opposite sides by flexing thereof; and (e) a filler strip having an engagement portion removably seated in one of said recesses other than said recesses along said opposite sides and a body portion substantially closing the entry to said other recess.

2. The door assembly in accordance with claim 1 wherein said filler strip is a retainer member having a retainer portion outwardly of said body portion providing a lip overlying a marginal portion of said trim panel.

3. The door assembly in accordance with claim 1 wherein said filler strip is a sealing member.

4. The door assembly in accordance with claim 1 wherein said recesses in said frame extend about the entire periphery of said glazing member.

5. The door assembly in accordance with claim 1 wherein said filler strip has a deflectable lip on said engagement portion which is deflectable during insertion into said recess.

6. The door assembly in accordance with claim 1 wherein said frame provides a channel in said recess spaced outwardly from said glazing member and a lip extending towards said glazing member.

7. The door assembly in accordance with claim 6 wherein said filler strip has a deflectable lip on said engagement portion which is deflectable during insertion into said recess and seats in said channel inwardly of said lip on said frame.

8. The door assembly in accordance with claim 7 wherein said filler strip body portion is closely spaced to the end of said lip on said frame.

9. The door assembly in accordance with claim 1 wherein said trim panel is fabricated from a synthetic resin sheet material.

10. The door assembly in accordance with claim 1 wherein said filler strip is fabricated from synthetic resin.

11. A door assembly including:

(a) a door having an aperture therein for mounting a window;

(b) a window frame mounted in said aperture and having inner surfaces defining an opening, said inner surfaces having aligned channels therein extending about said opening;

(c) a glazing member mounted in said channels of said frame, said inner surfaces of said frame also having recesses formed therein adjacent said glazing member extending along both surfaces thereof and along the exposed length of all sides thereof;

(d) a resiliently deflectable trim panel having opposed side edge portions and top and bottom edge portions, said trim panel overlying said glazing member with said opposed side edge portions being seated in the recesses along opposite sides of said glazing member and with said top edge portion being seated in the recess extending along the top thereof; and (e) a trim retainer having an engagement portion removably seated in the recess extending along the bottom of said glazing member, said trim retainer having a retainer portion extending outwardly of said recess and providing a lip overlying said bottom edge portion of said trim panel.

12. The door assembly in accordance with claim 11 wherein said trim retainer has a deflectable lip on said engagement portion which is deflectable during insertion into said recess.

13. The door assembly in accordance with claim 11 wherein said frame provides a channel in said recesses spaced outwardly from said glazing member and a lip extending towards said glazing member.

14. The door assembly in accordance with claim 13 wherein said trim retainer has a deflectable lip on said engagement portion which is deflectable during insertion into said recess, and said lip seats in said channel inwardly of said lip on said frame.

15. The door assembly in accordance with claim 14 wherein said trim retainer has a body portion which is closely spaced to the end of said lip on said frame.

16. The door assembly in accordance with claim 11 wherein said trim panel is fabricated from a synthetic resin sheet material.

17. The door assembly in accordance with claim 11 wherein said trim retainer is fabricated from synthetic resin.

18. In the method of making a door assembly, the steps comprising:

(a) providing a door having an aperture therein for mounting a window frame;

(b) mounting in said aperture a window frame having inner surfaces defining an opening, said inner surfaces having aligned channels therein extending about said opening, a glazing member mounted in said channels, said inner surfaces of said frame also having recesses formed therein adjacent said glazing member and extending along the exposed length of opposite sides of said glazing member and along the length of at least one other side thereof, said recesses being of lesser depth than said channels;

(c) flexing and inserting into said frame a resiliently deflectable trim panel having opposite sides and ends, said trim panel overlying said glazing member with its opposite ends seating in said recesses on opposite sides of said glazing member; and (d) inserting into and removably seating in another one of said recesses a filler strip having an engagement portion seated therein and a body portion substantially closing the entry to said another recess.

19. The method of making a door assembly in accordance with claim 18 wherein said filler strip is a retainer member having a retainer portion extending outwardly of said body portion and providing a lip overlying a marginal portion of said trim panel.

20. The method of making a door assembly in accordance with claim 19 wherein said filler strip is a sealing member.

21. The method of making a door assembly in accordance with claim 18 wherein said filler strip has a deflectable lip on said engagement portion which is deflected during insertion into said recess.

22. The method of making a door assembly in accordance with claim 18 wherein said trim panel is fabricated from a synthetic resin sheet material.

* * * * *